United States Patent [19]

Bergeron

[11] Patent Number: 5,005,538

[45] Date of Patent: Apr. 9, 1991

[54] EXTENDED CIRCUMFERENCE INTAKE POPPET VALVE SYSTEM FOR OPENING AND SEALING A SINGLE VALVE SEAT

[76] Inventor: Charles W. Bergeron, P.O. Box 17, Putnam Hall, Fla. 32185

[21] Appl. No.: 547,810

[22] Filed: Jul. 3, 1990

[51] Int. Cl.[5] ..... F01L 1/28; F01L 3/00

[52] U.S. Cl. ..... 123/79 R; 123/90.12; 123/188 AA; 123/188 R

[58] Field of Search ..... 123/79 R, 79 C, 90.12, 123/90.13, 188 R, 188 A, 188 AA

[56] References Cited

U.S. PATENT DOCUMENTS

| | | | |
|---|---|---|---|
| 1,690,384 | 11/1928 | Trego | 123/79 R |
| 1,765,359 | 6/1930 | Adamson | 123/79 R |
| 1,828,792 | 10/1931 | Tuerbakk | 123/79 C |
| 3,881,459 | 5/1975 | Gaetcke | 123/188 R |
| 4,094,277 | 6/1978 | Goto et al. | 123/79 C |
| 4,484,545 | 11/1984 | Madsen | 123/90.12 |
| 4,942,850 | 7/1990 | Hernandez | 123/79 C |

FOREIGN PATENT DOCUMENTS

| | | | |
|---|---|---|---|
| 11319 | 1/1977 | Japan | 123/79 R |
| 2155102 | 9/1985 | United Kingdom | 123/79 R |

*Primary Examiner*—Charles J. Myhre
*Assistant Examiner*—Weilun Lo
*Attorney, Agent, or Firm*—Malin, Haley, McHale, DiMaggio & Crosby

[57] ABSTRACT

An extended circumference intake poppet valve system for use with a single charge carrying intake duct/port to an engine cylinder in a four cycle internal combustion engine to include three or more annular intake poppet valves (secondary valves), annular valve seats (mini ports), disposed within a primary valve head which spans said single duct/port (valve system), said valve system in fluid communication with said duct and said cylinder for opening and sealing said duct/port at said duct seat, intake valve lifting and closing means, wherein the area of the duct/port, and the matched area of the open valves are substantially equal for an extended optimum charge flow period, and in addition, valve open areas at all valve lift points during the inlet event that occur, initially and throughout extended duration through closure, are enlarged when compared with a single poppet valve servicing the same duct-/port, resulting in greatly enhanced charge volume into the cylinder during the intake event.

2 Claims, 2 Drawing Sheets

EXTENDED CIRCUMFERENCE INTAKE POPPET VALVE SYSTEM FOR OPENING AND SEALING A SINGLE VALVE SEAT

BACKGROUND OF THE INVENTION

1. Field of the Invention

This invention relates to an intake valve for use in a four cycle internal combustion engine to increase volumetric efficiency, and specifically to a primary poppet intake valve with apertures that uses three or more secondary poppet valve bodies for opening and sealing said primary valve face, said primary poppet valve face opening and sealing a single intake duct and port seat.

The sum of the circumferential distances of the secondary poppet valves are specifically determined to accelerate valve opening value (circumference times lift) throughout the intake event, also simultaneously extending the duration of optimum valve opening area during the critical time frame of maximum piston velocity.

The purpose of the invention is to quantitatively increase the intake valve open area value (circumference times lift) of a single intake duct/port to enhance optimum charge flow into the combustion chamber during the intake event resulting in greater volumetric efficiency when compared with the valve open area value at varying lift points available with a single conventional intake poppet valve.

2. Description of Related Art

The use of one or more poppet intake valves in a single engine cylinder in a four cycle internal combustion engine is well known in prior art. Typically each intake duct and its corresponding port is serviced by one conventional intake poppet valve. The cross sectional area of the duct/port and the valve area value achieved (lift times circumference) at maximum valve lift generally match or exceed duct/port area to prevent impedance of the charge flow velocity during expurgation of same into the cylinder. Since the correct maximum valve open area value is the valve body circumference times maximum lift, conventional valve lift distances exceeding 0.350 thousandths inch are generally employed in engines of 500 cubic inches or less. Such lift distances encroach the mechanical limits of the cam lobe profile and the valve train components due to constraints during the intake event. The result is that maximum valve opening is achieved during a limited instantaneous position over the entire intake event's duration at the cam lobe profile. In essence during the intake event, the maximum charge available in the intake duct as determined by its cross sectional area is not provided to the cylinder throughout the major portion of the intake event.

Applicant's invention differs significantly from the conventional intake valve technology in that three or more secondary poppet valve bodies sealable to apertures are employed within a primary valve structure, said system to function in communication with a single duct/port resulting in an increased total valve circumference utility, thus defining an extended valve circumference, expanding valve open area values available throughout the intake event for an improved flow from a single duct/port, greatly increasing the volumetric efficiency of the engine.

BRIEF SUMMARY OF THE INVENTION

Three or more annular intake poppet valves (secondary valves) are used within a single annular intake poppet valve (primary valve), the secondary valves providing opening and sealing of multiple annular ports disposed about the axis of the primary valve face, said annular ports (hereafter "mini ports") traverse through the primary valve body resulting in communication of a singular generally annular intake duct and the engine cylinder. The primary and secondary valves all open their respective ports to service the engine cylinder. The poppet valve system is disposed about the axis of a single duct's port. The diameter of each secondary valve face is predetermined in size such that the sum total of the circumferential distances of the three or more secondary poppet valves at seat centerline exceeds the circumference of the duct/port seat at seat centerline by at least a factor of 1.2 or more. However, in area, the sum total of the secondary valves (three or more) generally equates to 50% or more of the area of the duct. The single duct transitions into an interface of multiple mini ports beginning at the primary valve's back face and exiting into the engine cylinder at the primary valve's front face (facing cylinder), which accommodates the multiple valve seats and their respective apertures (mini ports), this generally comprising the sealable portion of the "mini valves". When compared with the duct cross sectional area, the sum of the mini port areas is generally 50–80%, in order to prevent charge flow impedance or diffusion once secondary valve lift values (circumference times lift) match their respective mini port areas (end initial valve opening, start duration) primary valve lift off occurs, resulting in additional valve open area value to compliment the now on going optimized mini port charge flow. With the present invention, the duration of maximum charge flowability, the time period during valve and seat separation in which valve impedance of flow becomes ineffectual (this varies with R.P.M. due to RAM effect) until closure of the valve impedes flow, this maximum charge flowability period is greatly enhanced because of the additional valve circumference available at all lift points per unit time of the intake event.

Therefore, the important benefits of this invention occur because of first, the extended time of maximum charge flowability available for the intake charge flow into the engine cylinder from a single duct, and second, improved flowability prior to and after the maximum charge flowability period (initial opening and closure periods) thus allowing for greater volumetric efficiency achievement during the intake event. By increasing the available valve circumferential distance, the required maximum lift distance for the valve system is substantially less than conventional valve maximum lift distances, yet while improved per unit time charge flow into the engine cylinder continues. In practice, early achievement of enlarged valve opening area allows optimum charge flowability to occur throughout the intake event, whereas combined interaction of the primary poppet valve circumference, cam profile, and secondary multiple valve circumferences result in improved charge flow/volume to the engine cylinder by way of increased charge expurgation between all poppet valve bodies and their respective seats per unit time of engine operation for induction of charge, thus quantitatively improving volumetric efficiency.

There are three stages in the charge flow induction path that significantly affect the velocity and volume per unit time of charge flow through to the engine cylinder, namely the cross sectional area of the duct, the total areas of the port(s) defined by the valve seat(s), and the total area(s) defined by the valve(s) at lift positions during the valve event (circumference time valve lift). In the present invention, the use of the previously described poppet valve system for a single duct allows the physical dimensions of the duct diameter and area, the valve diameters and seat areas, and the valve circumferences times lift (valve open areas) to be optimized to minimize charge flow impedance initially and for an increased duration period throughout the intake event.

The invention could also be used with a fuel injection system that heretofore employed a single poppet valve to seal an injector head.

It is an object of this invention to provide an extended circumference intake valve system for use with one or more single intake duct/ports in a four cycle internal combustion engine to improve volumetric efficiency in a four cycle internal combustion engine.

It is another object of this invention to provide an extended circumference intake valve system for use with one or more single intake duct/ports which permits, prior to and after the significant period of piston velocity, the initial and closure periods, an achievement of improved flowability.

It is another object of this invention to provide an extended circumference intake valve system for use with one or more single intake duct/ports in a four cycle internal combustion engine which permits increased duration of maximum charge flowability at optimum valve open area during the significant period of piston velocity of the intake cycle to improve the volumetric efficiency of the engine.

It is another object of this invention to provide an extended circumference intake valve system for use with one or more single intake duct/ports that allows the engine designer to improve particular cam lobe parameters such as to delay opening the extended circumference intake valve system later as compared to conventional valve's earlier opening requirements, thus resulting in improved charge filling without extensive charge cross over (overlap).

Another object of this invention is to provide an extended circumference intake valve system that allows for retrofit replacement of conventional inlet valves to improve volumetric efficiency of existing engines.

Another object of this invention is to provide an improved intake valve in which the primary valve remains on seat longer during the intake event allowing for improved heat dissipation per unit time when compared with the time restraints of conventional poppet valve technology.

In accordance with these and other objects which will be apparent hereinafter, the instant invention will now be described with particular reference to the accompanying drawings.

PREFERRED EMBODIMENT OF THE INVENTION

In the preferred embodiment, three intake poppet valves (mini-valves) are symmetrically disposed about the axis of a primary valve face, said primary valve spans a single inlet duct valve seat.

Figure 1:
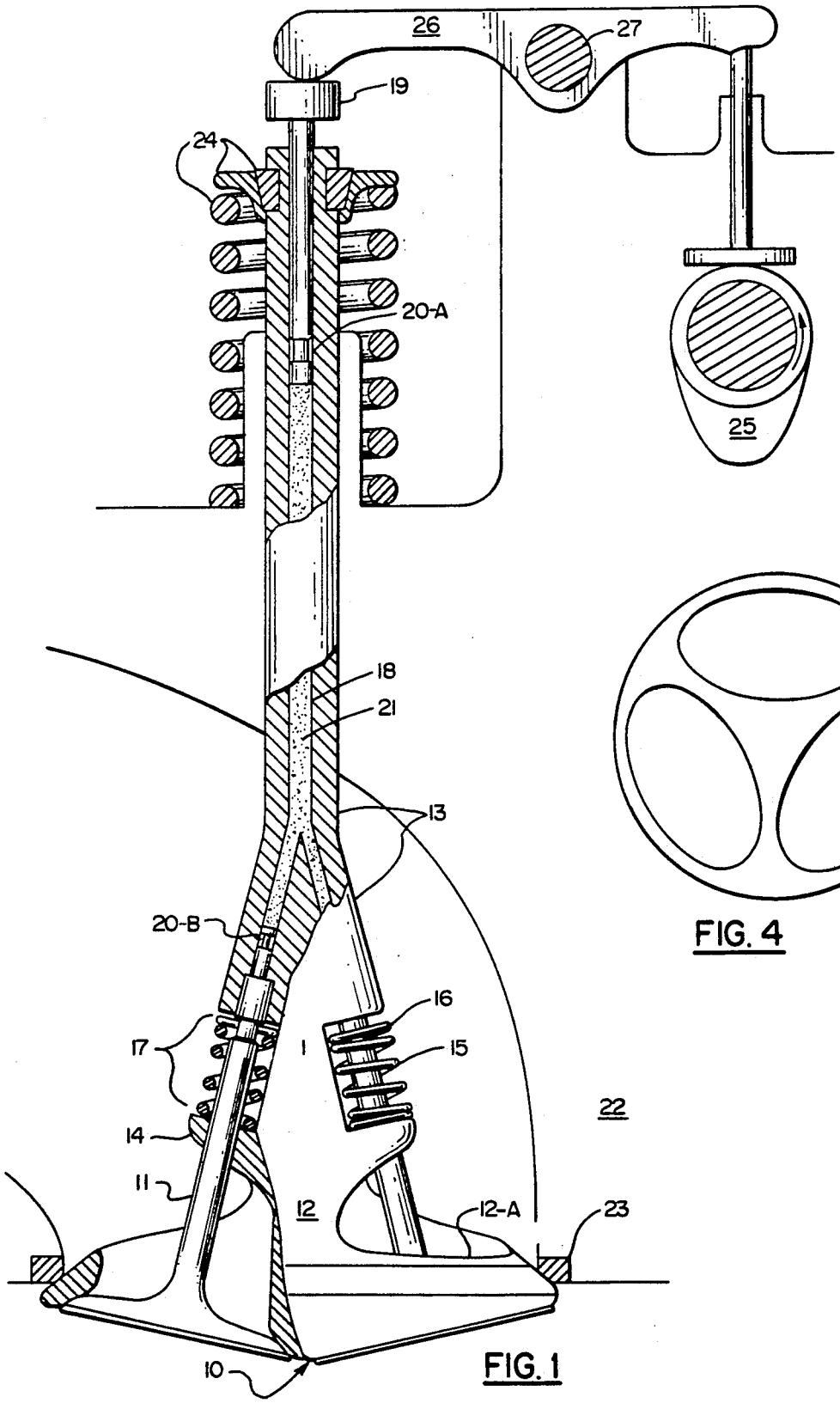
FIG. 1 shows a side elevational view partially cut away of the present invention.
Figure 4:
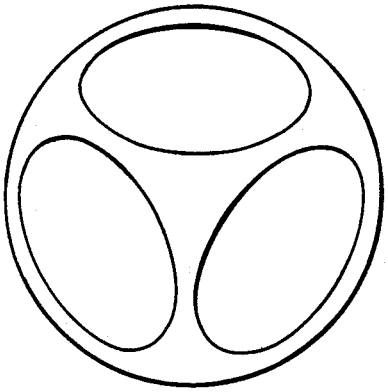
FIG. 4 shows a bottom plan view of the present invention.
Figure 2:
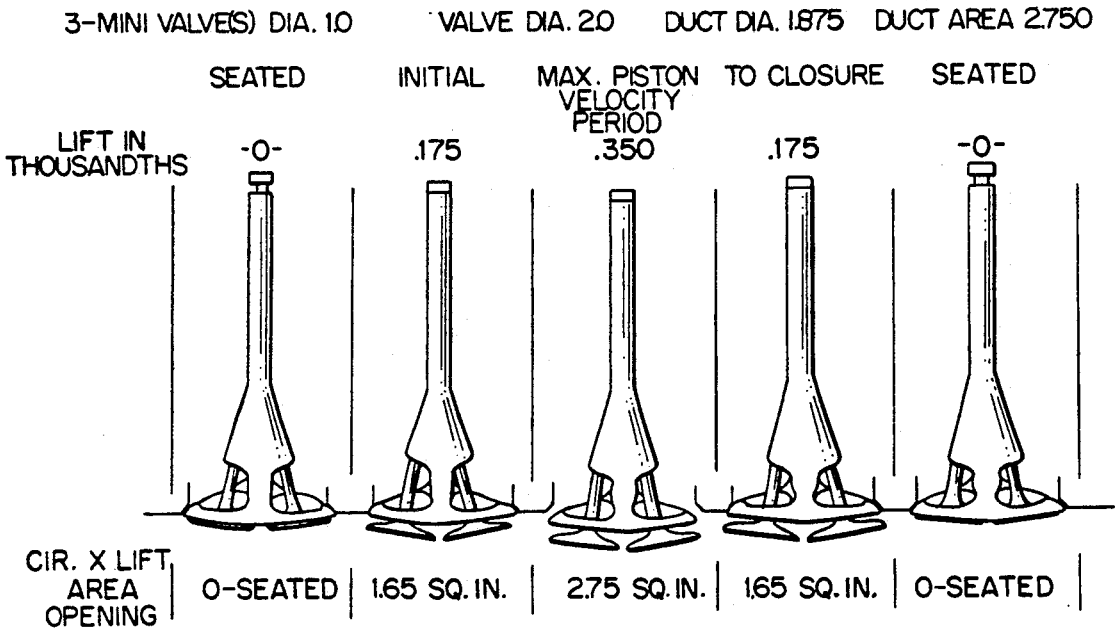
FIG. 2 shows a schematic diagram of the valve opening sequences in accordance with the present invention.
Figure 3:
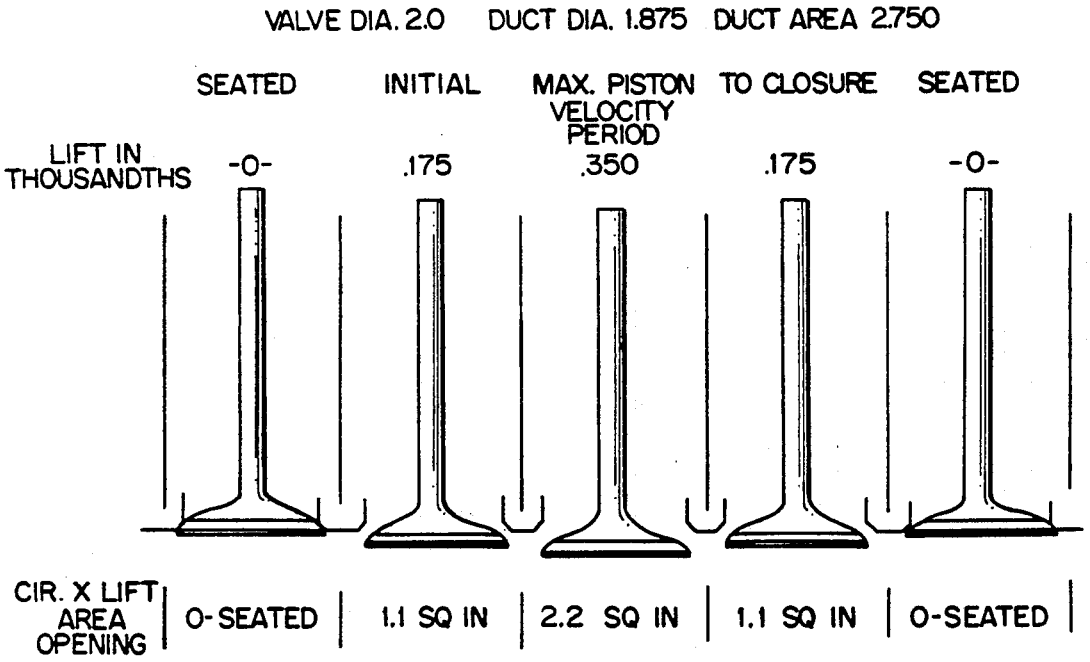
FIG. 3 shows a comparative schematic diagram of conventional poppet valve technology (prior art).

Referring now to FIG. 1, the invention is shown generally at 10 comprising three intake poppet valves (mini-valves) 11 cantedly disposed through apertures 12*a* and primary poppet valve 12, said primary poppet valve stem 13 having raised platforms 14, three such platforms being disposed equilaterally about the valve stem 13 at a 120 degree separation, said platforms guide valves 11 stems while supporting mini-springs 15 held in bias by way of retainers 16. Poppet valves 11 enter the upper portion of primary poppet valve stem 13 at the top of cavity 17 wherein poppet valves 11 are now double guided. Within valve stem 13 an oil galley 18 consistent within the axis of valve stem 13 branches to suit angularity alignment to communicate with valves stem ends. Plunger 19 is disposed at the entrance of oil galley 18, said plunger 19 and said valves 11 stems having adjacent to their ends, lip seals 20B and plunger 19 lip seals 20*a*. Within oil galley 18, air bled hydraulic fluid 21 is housed in order to complete push-pull communication of valves 11 by way of cam shaft 25 and springs 15 respectively.

The entire valve system heretofore described is slidably mounted into conventional cylinder head 22. The primary valve 12 is biased into its seated position upon a conventional valve seat 23 by way of conventional spring, retainer and keeper assembly 24, said valve assembly operable by cam shaft profile 25 interacting with rocker arm 26. The initial intake event occurs as rotational cam shaft profile 25 applies pressure to rocker arm 26 which in turn fulcrums at point 27 resultant in force upon plunger 19. Plunger 19 distributes force at lip seal 20*a*. Force continues by way of hydraulic fluid to lip seals 20*b* wherein valves 11 follow the lift regulated by cam shaft profile 25 until plunger 19 meets valve stem 13. A clearance is established between plunger 19 and the top of valve stem 13 as to a resultant maximum lift point for the secondary valves. When the plunger 19 contacts the end of valve stem 13, initial lift of primary valve 12 begins. The valve assembly with fully open valves 11 will now operate as a conventional valve through actuation by cam shaft profile 25, regulating the primary valve 12 seat contact wherein valves 11 and plunger 19 will react in reverse of their initial opening, the valve event now complete.

Valves 11 combined circumferences exceed the circumference of primary valve 12 thus allowing the charge passageway (circumference times lift) to be enlarged per unit time of the intake event before and after primary valve lift off to closure. Also the on-going charge flow about valves 11 will enhance charge flow efficiency during primary valve 12 lift off to closure period resultant in improved volumetric efficiency.

The instant invention has been shown and described herein in what it is considered to be the most practical and preferred embodiment. It is recognized, however, that departures may be made therefrom within the scope of the invention and that obvious modifications will occur to a person skilled in the art. For example, the hydraulic actuation of the secondary valves could be accomplished mechanically.

What I claim is:

1. An improved intake valve for an internal combustion engine to increase the volumetric efficiency of the engine comprising:

a primary poppet valve having a stem and a circular valve body with a valve seat face disposed around the perimeter of the circular valve body, said primary valve body having at least three apertures disposed there through, said apertures including annular valve seats;

at least three secondary smaller poppet valves each sized to fit sealably within each of the primary valve apertures respectively;

means for supporting at least three secondary poppet valves connecting said three secondary poppet valves to said primary valve; and means for opening and closing said secondary and primary poppet valves.

2. An improved intake valve as in claim 1, wherein:

said means for opening said secondary poppet valves includes hydraulic actuation means and a hydraulic fluid system.

* * * * *